US006548995B1

(12) United States Patent
Li

(10) Patent No.: US 6,548,995 B1
(45) Date of Patent: Apr. 15, 2003

(54) HIGH SPEED BIAS VOLTAGE GENERATING CIRCUIT

(75) Inventor: Jun Li, Foster City, CA (US)

(73) Assignee: Silicon Storage Technology, Inc., Sunnyvale, CA (US)

( * ) Notice: Subject to any disclaimer, the term of this patent is extended or adjusted under 35 U.S.C. 154(b) by 0 days.

(21) Appl. No.: 10/052,278

(22) Filed: Jan. 17, 2002

(51) Int. Cl.[7] ..... G05F 3/16
(52) U.S. Cl. ..... 323/314; 327/537; 327/543
(58) Field of Search ..... 323/313, 314; 327/535, 537, 538, 540, 541, 543

(56) References Cited

U.S. PATENT DOCUMENTS 5,296,801 A * 3/1994 Ohtsuka et al. ..... 323/313
5,483,152 A * 1/1996 Hardee et al. ..... 323/314
5,889,395 A * 3/1999 Lundberg ..... 323/313
6,339,318 B1 * 1/2002 Tanaka ..... 327/541
6,456,152 B1 * 9/2002 Tanaka ..... 327/537

* cited by examiner

*Primary Examiner*—Jeffrey Sterrett
(74) *Attorney, Agent, or Firm*—Gray, Cary, Ware & Freidenrich

(57) ABSTRACT

A high speed bias voltage generating circuit 10 for use with semiconductor devices. The bias voltage generating circuit 10 includes three circuits or circuit portions 12 , 14 and 16 which cooperatively control the output voltage and current of the circuit 10. The standby circuit 12 is active during a standby mode. The standby circuit 12 provides.a stable standby voltage $Vout_{standby}$ for the circuit 10, and generates substantially no current in standby mode. The bias circuit 14 is active during a bias mode and provides a stable bias voltage $Vout_{bias}$ for the circuit 10. The boost circuit 16 is active during the transition from standby mode to bias mode, and is effective to quickly lower or "pull down" the output voltage from $Vout_{standby}$ to $Vout_{bias}$.

20 Claims, 2 Drawing Sheets

HIGH SPEED BIAS VOLTAGE GENERATING CIRCUIT

FIELD OF THE INVENTION

This invention relates to a high speed bias voltage generating circuit and more particularly, to a high speed bias voltage generating circuit that may be adapted for use with a semiconductor device, that quickly generates a stable bias voltage in response to an input signal, and that consumes substantially no power when operating in a standby mode.

BACKGROUND OF THE INVENTION

Bias voltage generating circuits or "bias circuits" are typically used within semiconductor devices to provide bias voltages that are less than a supply voltage (e.g., Vcc or Vdd). Such bias voltages are often necessary to control or operate certain circuit elements or portions within semiconductor devices. By way of example, bias voltage generating circuits may be used within flash memory devices to drive word lines within the devices.

In order for the circuit elements or portions to respond and operate properly, it is desirable for bias circuits to generate a bias voltage rapidly (e.g., in response to an input signal changing value) and precisely. It is further desirable for bias circuits to have fast settling times (i.e., to provide bias voltages that stabilize in a very short period of time), and to consume little or no power while operating in a standby mode (i.e., when not providing the bias voltage).

There is therefore a need for a new and improved bias voltage generating circuit for use with semiconductordevices, which provides a relatively fast response and settling time, and which consumes substantially no power when operating in a standby mode.

SUMMARY OF THE INVENTION

A first non-limiting advantage of the invention is that it provides a high speed bias voltage generating circuit for use with semiconductor devices.

A second non-limiting advantage of the invention is that it provides a high speed bias voltage generating circuit having a very fast response and settling time.

A third non-limiting advantage of the invention is that it provides a high speed bias voltage generating circuit that consumes substantially no power while operating in a standby mode.

According to a first aspect of the present invention, a high speed bias voltage generating circuit is provided. The circuit includes a first node for receiving an input signal; a second node for providing an output voltage; -and first, second and third circuits. The first circuit is coupled to the first node and the second node, and is adapted to provide a standby. voltage and substantially: no output current to the second node when the input signal has a first value. The second circuit is coupled to the first node and the second node, and is adapted to provide a bias voltage to the second node when the input signal has a second value different from the first value. The third circuit is coupled to the first node and to the second node, and is, adapted to cause the output voltage to be rapidly lowered from the standby voltage to a value close to the bias voltage after the input signal switches from the first value to the second value.

According to a second aspect of the present invention, a high speed bias voltage generating circuit is provided. The circuit includes an input terminal that provides an input signal; an output terminal that receives an output signal; a standby circuit portion which is coupled to the input and output terminals, which is active only when the input signal has a first value, and which-is adapted to provide a standby voltage at the output terminal when active; a bias circuit portion which is coupled to the input and output terminals, which is active only when the input signal has a second value different from the first value, and which is adapted to provide a bias voltage at the output terminal when active; and a boost circuit portion which is coupled to the input and output terminals, which is active only during a predetermined period of time after the input signal switches from the first value to the second value, and which is adapted to cause the output voltage to rapidly approach the bias voltage during the predetermined period of time.

According to a third aspect of the present invention, a method is disclosed for providing a bias voltage in response to an input signal. The method includes the steps of: providing a standby voltage at an output node by use of a first circuit when the input signal has a first value; providing a bias voltage at the output node by use of a second circuit when the input signal has a second value and quickly -lowering the voltage at the output node from the standby voltage to the bias voltage by use of a third circuit, when the input signal switches from the first value to the second value.

These and other features, advantages, and objects of the invention will become apparent by reference to the following specification and by reference to the following drawings.

DETAILED DESCRIPTION OF THE PREFERRED EMBODIMENT OF THE INVENTION

Figure 1:
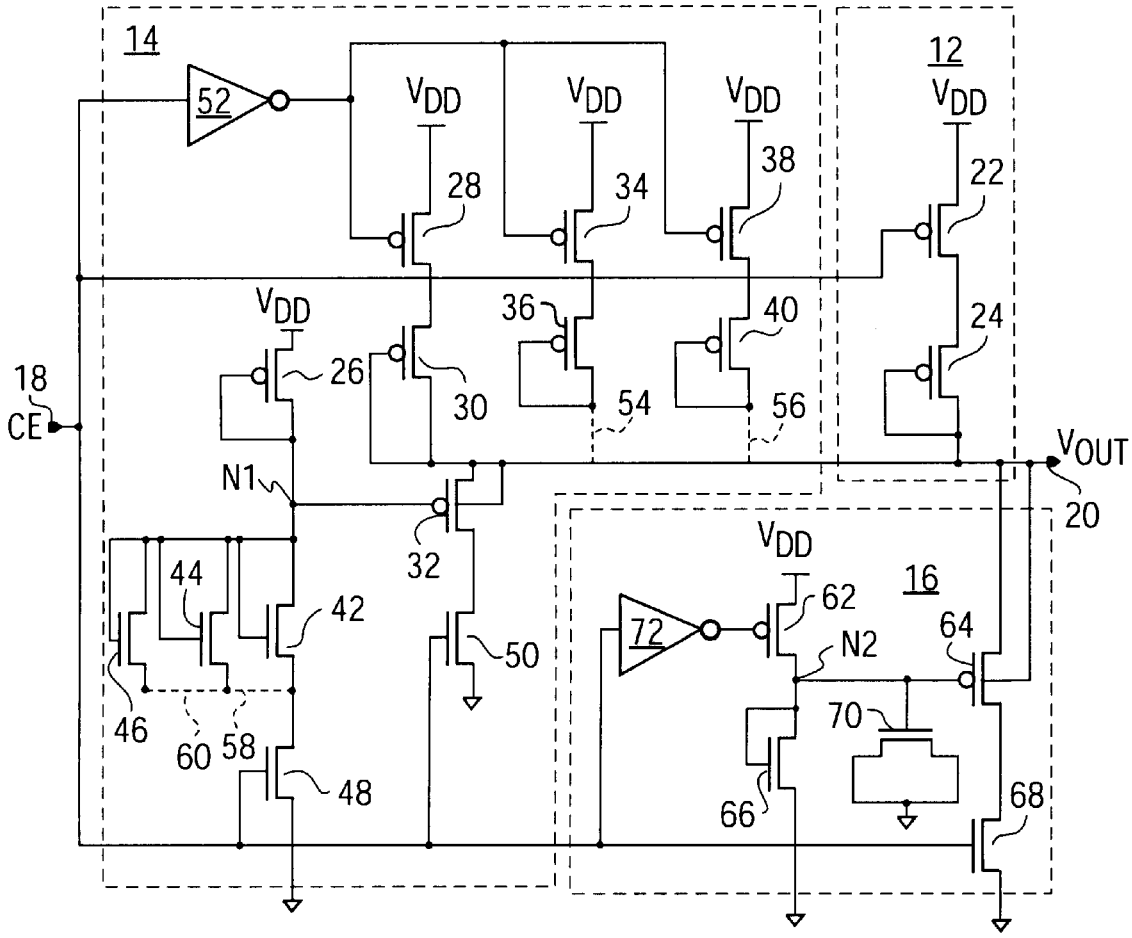
FIG. 1 is a schematic diagram illustrating a high speed bias voltage generating circuit which is made in accordance with the teachings of the present invention.

Referring now to FIG. 1, there is shown a high speed bias voltage generating circuit 10 that is made in accordance with the teachings of the preferred embodiment of the present invention aid that is adapted for use within a conventional semiconductor integrated circuit device. By way of example and without limitation, circuit 10 may be used to drive one or more word lines within a flash memory device.

In the preferred embodiment, circuit 10 is formed from a plurality of conventional field effect transistors, such as metal-oxide-semiconductor ("MOS") transistors, including conventional n-channel ("NMOS") transistors and p-channel ("PMOS") transistors. It should be appreciated by one of ordinary skill in the art that different and/or additional types of suitable transistors may be used to form a high speed bias voltage generating circuit within the scope present invention.

In the preferred embodiment, circuit 10 includes three linked circuits or circuit portions 12, 14 and 16 that operate in a cooperative manner to provide the high speed bias voltage generating function of the present invention. Particularly, circuit 10 Includes a standby voltage circuit or portion 12, which is effective to control the output voltage (Vout) of circuit 10 at node or terminal 20 during a "standby" mode (e.g., when the input voltage signal (CE) at the input node or terminal 18 is low); a bias voltage circuit or portion 14, which is effective to control the output voltage Vout during an "active" mode (e.g., when the input voltage signal CE at node 18 is high); and a boost portion or circuit 16, which is effective to control the output voltage Vout for a relatively short period of time after a transition from standby to active mode (e.g., when the input voltage-signal CE transitions from low to high).

Standby circuit or portion 12 includes a pair of PMOS transistors 22, 24, which are serially coupled together between the supply voltage (Vdd) and the output node 20. The source of PMOS transistor 22 is coupled to supply voltage Vdd, the drain of PMOS transistor. 22 is coupled to the source of PMOS transistor 24, and the gate of PMOS transistor 22 is coupled to the input node 18. The gate and drain of PMOS transistor 24 are coupled together, and are further coupled to the output node 20. As is well known in the art, the "source" and "drain" of the transistors described herein may be interchanged.

The bias circuit or portion 14 includes a plurality of PMOS transistors 26–40, a plurality of NMOS transistors 42–50, and an inverter 52. PMOS transistors 28, 30 are serially coupled together between the supply voltage Vdd and the output node 20. Particularly, the source of PMOS transistor 28 is coupled to supply voltage Vdd, the gate of PMOS transistor 28 is coupled to the output of inverter 52, and the drain of PMOS transistor 28 is coupled to the source of PMOS transistor 30. The gate and drain of PMOS transistor 30 are coupled together, and are further coupled to the output node 20.

PMOS transistor pairs 34, 36 and 38, 40 are each respectively and serially coupled together. Particularly, the source of each PMOS transistor 34, 38 is coupled to supply voltage Vdd, the gate of each PMOS transistor 34, 38 is coupled to the output of inverter 52, and the drain of each PMOS transistor 34, 38 is coupled to the source of PMOS transistor 36, 40, respectively. The gate and drain of each PMOS transistor 36, 40 are respectively coupled together. The PMOS transistor pairs 34, 36 and 38, 40 may be selectively coupled in a parallel relationship with PMOS transistor pair 28, 30, by use of optional connections 54, 56. That is, based on the intended application of circuit 10, a designer has the option to electrically connect each PMOS transistor pair 34, 36 and 38, 40 to output node 20, as illustrated by the optional connections 54, 56, respectively. By forming the optional connections 54, 56 (e.g., during or after the circuit fabrication process), PMOS transistor pairs 34, 36 and 38, 40 will be operatively disposed in a parallel relationship with PMOS transistor pair 28, 30. As discussed below, by connecting the PMOS transistor pair 34, 36 and/or pair 38, 40 in parallel with PMOS transistor pair 28, 30, a designer can increase the magnitude of the output bias current. (Iout) in order to suit a given application. It should be appreciated that when the optional connections 54, 56 are not formed (i.e., are disconnected), PMOS transistor pairs 34, 36 and 38, 40 have substantially no effect on the operation of circuit 10.

PMOS transistor 26 is coupled between supply voltage Vdd and node N1. Particularly, the source of PMOS transistor 26 is coupled to Vdd, and the gate and drain of PMOS transistor 26 are coupled together and are coupled to node N1. Node N1 is further coupled to output node 20, to the gate PMOS transistor 32, and to the drains and gates of NMOS transistors 42, 44 and 46, which are coupled together The source of NMOS transistor 42 is coupled to the drain of NMOS transistor 48. The gate of NMOS transistor 48 is coupled to input node 18, and the source of NMOS transistor 48 is coupled to ground.

The NMOS transistors 44, 46 may be selectively coupled in a parallel relationship with NMOS transistor 42, by use of optional connections 58, 60, which may be formed during or after fabrication of circuit 10. That is, based on the intended application of the circuit 10, a designer has the option to electrically connect NMOS transistor 44 or NMOS transistors 44, 46 in parallel with NMOS transistor 42, as illustrated by the optional connections 58, 60. As discussed below, by connecting the NMOS transistor 44 or NMOS transistors 44, 46 in parallel with NMOS transistor 42, a designer can adjust the magnitude of the output bias voltage $Vout_{bias}$ in order to best suit a given application. It should be appreciated that when the optional connections 58, 60 are not formed. (i.e., are disconnected), NMOS transistors 44 and 46 have substantially no effect on the operation of circuit 10.

The source of PMOS transistor 32 is electrically coupled to the output node 20, and the drain of PMOS transistor 32 is coupled to the drain of NMOS transistor 50. The gate of NMOS transistor 50 is electrically coupled to the input .node 18 and the source of NMOS transistor 50 is coupled to ground.

The input of inverter 52 is coupled to input node 18, and the output of inverter 52 is coupled to the gates of NMOS transistors 28, 34 and 38, and provides an inverted input.signal to NMOS transistors 28, 34 and 38.

The boost circuit or portion 16 includes PMOS transistors 62, 64, NMOS transistors 66, 68 and 70, and inverter 72. The source of PMOS transistor 62 is coupled to supply voltage Vdd and the drain of PMOS transistor 62 is coupled to node N2. The gate of PMOS transistor 62 is coupled to and receives an inverted input signal from the output of inverter 72. The input of inverter 72 is coupled to input node 18. The gate and drain of NMOS transistor 66 are coupled together and are coupled to node N2, and the source of NMOS transistor 66 is coupled to ground.

Transistors 64, 68 are serially coupled together between the output node 20 and ground. The source of PMOS transistor 64 is coupled to output node 20, the gate of PMOS transistor 64 is coupled to node N2, and the drain of PMOS transistor 64 is coupled to the drain of NMOS transistor 68.

The gate of NMOS transistor 68 is. electrically coupled to and receives an input signal CE from input node 18, and the source of NMOS transistor 68 is coupled to ground.

The source and drain of NMOS transistor 70 are coupled together, effective to cause NMOS transistor 70 to operate as a capacitive element. The gate of NMOS transistor 70 is coupled to node N2. The source and drain of NMOS transistor 70 are coupled to ground. In alternate embodiments, transistor 70 may be replaced with a conventional capacitor.

In operation, the circuit portions 12, 14 and 16 operate together to provide an output voltage Vout at the output node 20, based upon the value of the input signal CE at the input node 18. Circuit 10 operates in a standby mode when input signal CE is "low" or 0 (i.e., when CE has a relatively low voltage or logic zero value). When CE is 0, circuits 14 and 16 are off or deactivated, and circuit 12 is activated. Particularly, the low signal at node 18 deactivates or "turns off" transistors 28, 34, 38, 48, and 50 of circuit 14, deactivates or "turns off" transistors 62 and 68 of circuit 16, and activates or "turns on" PMOS transistor 22 of circuit 12. The activation of PMOS transistor 22 causes the output voltage Vout at node 20 during standby (i.e., $Vout_{standby}$) to be equal to the supply voltage Vdd minus the voltage drop over PMOS transistor 24, which is approximately equal to the threshold voltage of PMOS transistor 24 (Vtp1), or $Vout_{standby}$=Vdd−Vtp1. It should be appreciated that PMOS transistor 24 may be selected such that Vtp1 is less than Vdd It should further be appreciated that the output current during standby mode (i.e., $Iout_{standby}$) will be approximately zero.

The boost circuit 16 is active for a relatively short period of time after the input signal transitions from 0 to 1. the circuit 10 is in a standby mode (i.e., when CE=0), the voltage at node N2 (and at the gate of PMOS transistor 64) is approximately 0 volts to 0.7 volts, depending on the size or strength of NMBS transistor 66 and the length-of time that the circuit 10 has been in standby mode. Therefore, during standby mode, PMOS transistor 64 is turned on or active. This, however, does not affect $Vout_{standby}$, as NMOS transistor 68 is turned off or deactivated at this time. Once the input signal CE switches from 0 to 1, the NMOS transistor 68 is turned on, thereby generating a current in. PMOS transistor 64, effective to very quickly "pull down" or lower the output voltage Vout. Concomitantly, the transistor 62 is turned on and begins charging the capacitive element 70. Once the capacitive element 70 is substantially charged, the voltage at the gate of PMOS transistor 64 is raised to a level that is effective to turn off or deactivate the transistor 64, thereby terminating the "pull down" effect of circuit 16. The strengths of transistors 62, 64, 66, and 70 will be selected, in a manner known to one of ordinary skill in the art, such that circuit 16 will pull down Vout to a value substantially close to $Vout_{bias}$ from $Vout_{standby}$. When Vout becomes substantially close to $Vout_{bias}$, the circuit 16 will be deactivated (i.e., PMOS transistor 64 will turn off), and circuit 14 will control and stabilize the value of $Vout_{bias}$.

It should further be appreciated that circuit 12 will be deactivated as soon as the input. signal CE switches from 0 to 1, and will have no further substantial effect on the circuit, until CE switches back to 0. When CE switches back to 0, circuits 14, 16 are immediately deactivated, and circuit 12 is activated immediately, thereby immediately providing the output voltage $Vout_{standby}$.

After input signal CE has remained "high" or 1 for some predetermined period of time, the circuit 10 is in an active or "bias" mode. When circuit 10 is in bias mode, circuit 14 is activated, and circuits 12 and 16 are deactivated. Particularly, the high signal at node 18 activates or "turns on"transistors 28, 34, 38, 48, and 50 of circuit 14, and deactivates or "turns off" PMOS transistor 22 of circuit 12. It should be appreciated that while transistors 62 and 68 of circuit 16 will-be activated, the circuit 16 will not affect the general operation of circuit 10 in bias mode, since the transistor 64 will be deactivated, effective to disconnect circuit 16 from the output node 20.

When input signal CE is "high" or 1, PMOS transistor 22 is off, thereby deactivating-circuit 12. While in bias mode, PMOS transistor 28 is activated and the path created by transistors 28, 30 provides an output bias current $Iout_{bias}$. The present discussion will assume that options 54, 56 have not been connected, and therefore PMOS transistor pairs 34, 36 and 38, 40 will not affect the operation of circuit 10. The magnitude of $Iout_{bias}$ is determined primarily by transistors 28, 30 operating in concert with transistors 32, 50. One of ordinary skill in the art will know how to determine-the "strength" of transistors 28, 30., 32, and 50 in a conventional manner to control the magnitude of $Iout_{bias}$ in order to suit a given application. The term "strength" as used herein will refer to the ability of a transistor to drive current, given certain operating conditions and process technology. Accordingly, the terms ."stronger" and "weaker" as used herein will respectively refer to a transistor's ability to drive more or less current relative to another transistor.

In the preferred embodiment, PMOS transistor 32 will be significantly stronger than PMOS transistor 30. As a result, the output bias voltage $Vout_{bias}$ will be substantially determined by the voltage at the gate of transistor 32 (i.e., the voltage at node N1). The output bias voltage $Vout_{bias}$ will be approximately equal to the voltage at the gate of transistor 32 (Vg2) plus the threshold voltage of transistor 32 (Vt2), or $Vout_{bias} \geqq Vg2+Vt2$. The voltage at the gate of transistor 32 Vg2 (i.e., the voltage at node N1) is determined by the "voltage divider" formed by PMOS transistor 26 and NMOS transistor 42 (assuming transistors 44, 46 are disconnected). Based upon the respective strengths of the transistors 26 and 42, the voltage at node N1 may vary between 0 and Vdd. In one non-limiting embodiment, the transistors 26, 42 and 32 will be selected, such that Vg2 will equal approximately 1.2 volts, and Vt2 will equal approximately 0.8 volts, effective to provide a bias voltage $Vout_{bias}$ of approximately 2 volts. One of ordinary skill in the art will know how to select transistors 26, 42 and 32 in order to suit a particular application and to provide a desired bias voltage $Vout_{bias}$. It will further be appreciated by one of ordinary skill in the art that connecting NMOS transistor 44 and/or 46 (i.e., by use of optional connections 58 and 60) will be effective to raise or lower the value of Vg2 during bias .mode based upon the strength of transistors 44, 46, thereby altering the value of $Vout_{bias}$.

Figure 2:
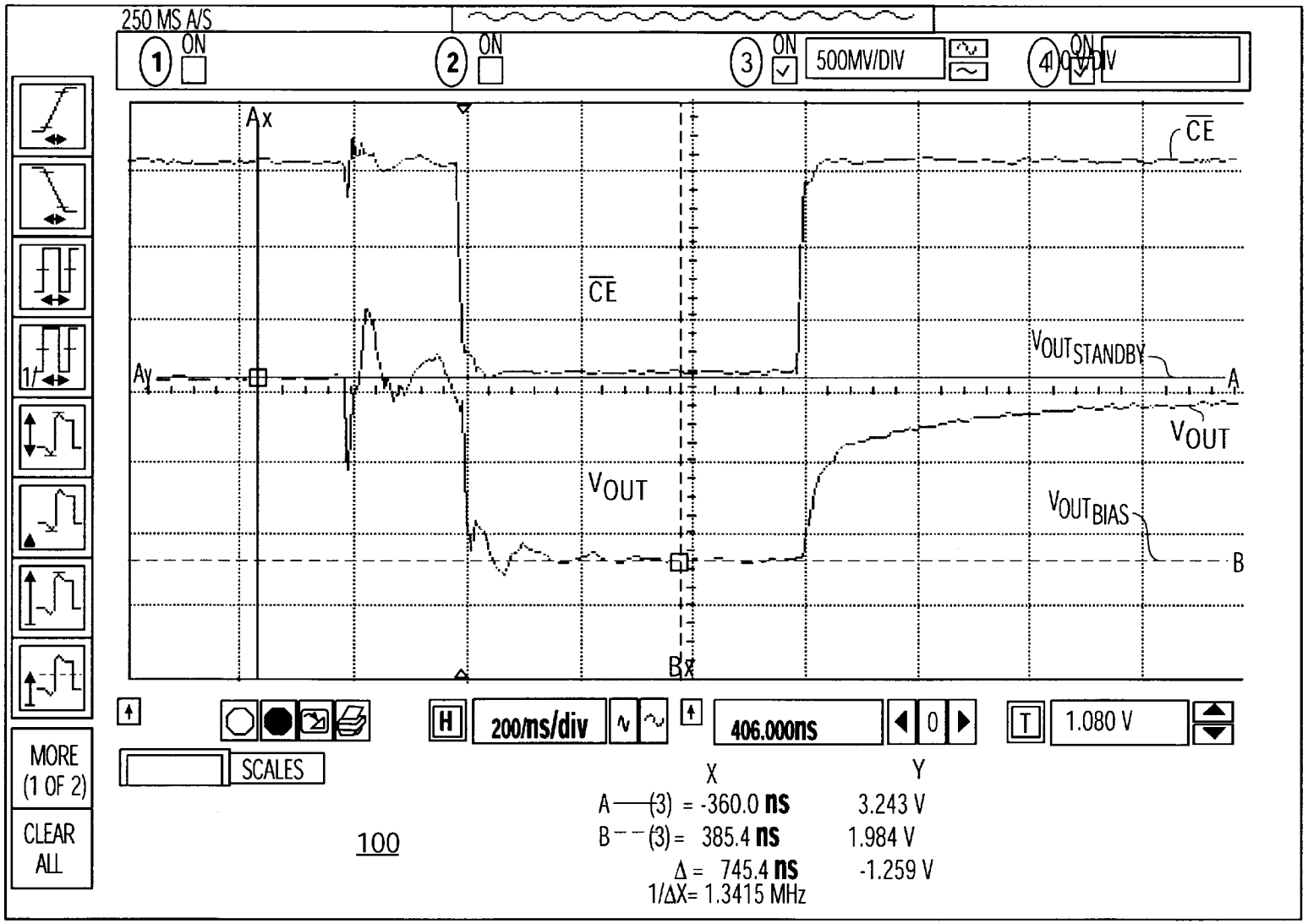
FIG. 2 is a graph illustrating the response of the high speed bias voltage generating.circuit to an input signal.

Circuit 10 provides a high speed bias voltage generating circuit that provides a bias voltage at a very high speed in response to an input signal. Moreover, the bias voltage provided by circuit 10 has a very fast settling time and is very stable. Furthermore, the circuit 10 consumes substantially no power while operating in a standby mode. FIG. 2 illustrates a graph 100 containing output data for one non-limiting embodiment of circuit 10 on real silicon. In graph 100, the output voltage Vout is plotted against the inverse of the input signal or $\overline{CE}$. As illustrated by graph 100, the output voltage Vout is "pulled down" to the desired bias voltage value $Vout_{bias}$ from the standby voltage value $Vout_{standby}$ very quickly after the input signal CE switches from 0 to 1 (i.e., after the inverted input signal $\overline{CE}$ switches from 1 to 0). Furthermore, as illustrated by graph 100, the output voltage Vout stabilizes at $Vout_{bias}$ very quickly after the input signal CE switches from 1 to 0 (i.e., after the inverted input signal $\overline{CE}$ switches from 0 to 1) .

It should be understood that the inventions described herein are provided by way of example only and that numerous changes, alterations, modifications, and substitutions- may be made without departing from the spirit and scope of the inventions as delineated within the following claims.

What is claimed is:

1. A high speed bias voltage generating circuit comprising:

a first node for receiving an input signal;

a second node for providing an output voltage;

a first circuit that is coupled to said first node and said second node, said first circuit being adapted to provide a standby voltage and substantially no output current to said second node when said input signal has a first value;

a second circuit that is coupled to said first node and said second node, said second circuit being adapted to provide a bias voltage to said second node when said input signal has a second value different from said first value; and a third circuit that is coupled to said first node and to said second node, said third circuit being adapted to cause said output voltage to be changed from said standby voltage to a value substantially close to said bias voltage after said input signal switches from said first value to said second value.

2. The high speed bias voltage generating circuit of claim 1 wherein said first circuit is deactivated when said input signal has said second value.

3. The high speed bias voltage generating circuit of claim 2 wherein said second circuit generates substantially no current when said input signal has said first value.

4. The high speed bias voltage generating circuit of claim 3 wherein said first circuit comprises first and second transistors which are serially connected between a supply voltage and said output node.

5. The high speed bias voltage generating circuit of claim 4 wherein said second circuit is deactivated when said input signal has said first value.

6. The high speed bias voltage generating circuit of claim 5 wherein said second circuit comprises at least one pair of first and second transistors which are serially coupled together between said supply voltage and said output node and which provide an output current for driving a load on said output node when said input signal has said second value.

7. The high speed bias voltage generating circuit of claim 6 wherein said second circuit further comprises third and fourth transistors which are serially coupled between said output node and ground, and which are adapted.to provide said bias voltage to said output node when said input signal has said second value.

8. The high speed bias voltage generating circuit of claim 7 wherein said second circuit further comprises a plurality of transistors which are coupled to the gate of said third transistor, and which are adapted to control the value of said bias voltage.

9. The high speed bias voltage generating circuit of claim 5 wherein said third circuit is active only for a predetermined period of time after said input signal switches from said first value to said second value.

10. The high speed bias voltage generating circuit of claim 5 wherein said third circuit comprises: first and second transistors which are serially coupled together between said output node and ground, and which are adapted to rapidly lower the voltage of said output node when said input signal switches from said first value to said second value; and a capacitive element which is coupled to said first transistor and which is adapted to turn off said first transistor after said predetermined period of time, thereby deactivating said third circuit.

11. A high speed bias voltage generating circuit comprising:

an input terminal that receives an input signal;

an output terminal that provides-an output signal;

a standby circuit portion which is coupled to said input and output terminals, which is active only when said input signal has a first value, and which is adapted to provide a standby voltage at said output terminal when active;

bias circuit portion which is coupled to said input and output terminals, which is active only when said input signal has a second value different from said first value, and which is adapted to provide a bias voltage at said output terminal when active; and a boost circuit portion which is coupled to said input and output terminals, which is active only during a predetermined period of time after said input signal switches from said first value to said second value, and which is adapted to cause said output voltage to rapidly approach said bias voltage during said predetermined period of time.

12. The high speed bias voltage generating circuit of claim 11 wherein said standby circuit portion comprises a plurality of first transistors.

13. The high speed bias voltage generating circuit of claim 12 wherein said bias circuit portion comprises a plurality of second transistors which are adapted to provide an output current for driving a load on said output terminal when said input signal has said second value.

14. The high speed bias voltage generating circuit of claim 13 wherein said bias circuit portion further comprising a plurality of third transistors which may be optionally coupled to said plurality of second transistors effective to increase said output current.

15. The high speed bias voltage generating circuit of claim 14 wherein said bias circuit includes a plurality- of fourth transistors which form a voltage divider for controlling said bias voltage.

16. The high speed bias voltage generating circuit of claim 15 further comprising a plurality of fifth transistors which may.be optionally coupled to said voltage divider, effective to alter said bias voltage.

17. A method for providing a bias voltage in response to an input signal, comprising the steps of:

providing a standby voltage at an output node by use of a first circuit when said input signal has a first value;

providing a bias voltage at said output node by use of a second circuit when said input signal has a second value; and quickly lowering the voltage at said output node from said standby voltage to said bias voltage by use of a third circuit, when said input signal switches from said first value to said second value.

18. The method of claim 17 further comprising the step of:

deactivating said third circuit after a predetermined period of time after said input signal switches from said first value to said second value.

19. The method of claim 18 further comprising the step of:

deactivating said second circuit when said input signal has said first value.

20. The method of claim 19 further comprising the step of:

deactivating said first circuit when said input signal has said second value.

* * * * *